US008556349B2

(12) United States Patent
Welch et al.

(10) Patent No.: US 8,556,349 B2
(45) Date of Patent: Oct. 15, 2013

(54) INFANT SUPPORT STRUCTURE

(75) Inventors: Juliette Marlene Welch, East Aurora, NY (US); John S. Canna, Orchard Park, NY (US); Theresa R. Rojek, Buffalo, NY (US); Gregory Scott Young, Lancaster, NY (US)

(73) Assignee: Mattel, Inc., El Segundo, CA (US)

( * ) Notice: Subject to any disclaimer, the term of this patent is extended or adjusted under 35 U.S.C. 154(b) by 71 days.

(21) Appl. No.: 12/705,832

(22) Filed: Feb. 15, 2010

(65) Prior Publication Data

US 2011/0198905 A1 Aug. 18, 2011

(51) Int. Cl.

| | |
|---|---|
| ***A47C 1/00*** | (2006.01) |
| ***A63G 9/10*** | (2006.01) |
| ***A63G 13/00*** | (2006.01) |

(52) U.S. Cl.

USPC ..... 297/344.21; 297/DIG. 11; 297/181; 482/135

(58) Field of Classification Search

USPC ..... 472/135, 95; 297/5, 181, 344.21, 297/344.24, 344.12, 344.13, 219.12, 274, 297/258.1, 259.1, DIG. 11, 452.13; 482/68, 482/77

See application file for complete search history.

(56) References Cited

U.S. PATENT DOCUMENTS

| | | | | |
|---|---|---|---|---|
| 1,941,722 | A | | 1/1934 | Stockil |
| 2,454,599 | A | | 11/1948 | Dunson |
| 2,613,722 | A | | 10/1952 | Ruppert |
| D183,974 | S | | 11/1958 | Norman et al. |
| 3,049,350 | A | | 8/1962 | Walker |
| 3,078,479 | A | | 2/1963 | Grosse et al. |
| 3,210,076 | A | * | 10/1965 | Walker ..... 472/97 |
| 3,578,381 | A | | 5/1971 | Young |
| 3,747,596 | A | | 7/1973 | Mills |
| 4,160,553 | A | * | 7/1979 | Fleischer ..... 280/87.051 |
| 4,746,044 | A | | 5/1988 | Arvizu et al. |
| 4,858,991 | A | | 8/1989 | Boyesen |
| 4,976,494 | A | | 12/1990 | Polley |
| 5,330,250 | A | | 7/1994 | Reyes |
| D356,447 | S | | 3/1995 | Peters |
| 5,433,682 | A | * | 7/1995 | Fermaglich et al. ..... 482/66 |
| 5,503,458 | A | * | 4/1996 | Petrie ..... 297/452.13 |
| 5,518,475 | A | | 5/1996 | Garland |
| 5,688,211 | A | | 11/1997 | Myers |
| 5,727,800 | A | | 3/1998 | Liu |
| 6,048,290 | A | | 4/2000 | Chen et al. |
| 6,817,864 | B1 | | 11/2004 | Martinez |
| 7,090,295 | B2 | | 8/2006 | Bodinek |
| 2004/0198501 | A1 | | 10/2004 | Henderson |
| 2007/0205646 | A1 | * | 9/2007 | Bapst et al. ..... 297/261.1 |
| 2008/0090669 | A1 | | 4/2008 | Sonner et al. |
| 2008/0179928 | A1 | * | 7/2008 | Chen et al. ..... 297/260.1 |
| 2009/0015046 | A1 | | 1/2009 | McClintock et al. |

* cited by examiner

*Primary Examiner* — Milton Nelson, Jr.
(74) *Attorney, Agent, or Firm* — Edell, Shapiro & Finnan LLC

(57) ABSTRACT

A bouncing seat for a child includes a seat support having an opening for receiving the child, a base, a post connected to and extending upwardly from the base, and first and second arms extending outwardly from a distal end of the post. The first and second arms are connected to the seat support, thereby connecting the seat support to the base. The post is aligned with the opening.

24 Claims, 15 Drawing Sheets

INFANT SUPPORT STRUCTURE

FIELD OF THE INVENTION

The present invention relates to an infant support structure, and in particular a bouncing seat, including a seat support having an opening for receiving a child, a base configured to engage a supporting surface, and a post connected to and extending upwardly from the base. The post is aligned with the opening. First and second arms extend outwardly from a distal end of the post and are connected to the seat support, thereby connecting the seat support to the base.

BACKGROUND OF THE INVENTION

Various infant support structures that support an infant or child above a support surface are known. Some infant support structures, referred to as bouncer seats, include a seat that is configured to support a child so that the child can bounce relative to the support surface while being supported by the seat. Conventional infant support structures, and in particular bouncers, are relatively bulky. As such, they are not practical in areas with limited space. There is a need for an infant support structure having a relatively compact configuration.

SUMMARY OF THE INVENTION

The present invention relates to a jumper/entertainer seat for a child including a support portion for supporting a child, a base configured to engage a supporting surface, and a post having a first end connected to and extending upwardly from the base and an opposite second end. A U-shaped connector is connected to and extends upwardly from the second end of the post. The U-shaped connector has a first arm and a second arm, each of which is connected to the support portion.

In one embodiment, the support portion includes an opening and the post is aligned with the opening. In another embodiment, a longitudinal axis of the post is aligned with the opening.

In another embodiment, the first end of the post is rotatably connected to the base. In another embodiment, the U-shaped connector and the post collectively have a Y-shaped configuration.

In another embodiment, each of the first arm and the second arm are adjustably connected to the support portion in at least a first position and a second position so that a distance between the support portion and the base is adjustable.

In another embodiment, the support portion includes a seat formed of a fabric material. The seat has first and second apertures for accommodating the child's legs. At least a first flap extends downwardly from an underside of the seat and intermediate the first and second apertures. The flap has a first end coupled to the first arm and an opposite second end coupled to the second arm.

The present invention also relates to a jumper/entertainer seat including a seat support having an opening for receiving a child, a base configured to engage a supporting surface, and a post having a first end connected to the base and an opposite second end. The post extends upwardly from the base and is aligned with the opening. First and second arms extend outwardly from the second end of the post and are connected to the seat support, thereby connecting the seat support to the base.

In one embodiment, the post includes a first connector portion and a second connector portion. The first connector portion may be rotatably connected to the second connector portion so that the seat support is rotatable relative to the base.

In one embodiment, the first connector portion is slidable toward and away from the second connector portion to allow movement of the seat support toward and away from the base.

In another embodiment, the first arm is connected to a front portion of the seat support and the second arm is connected to a rear portion of the seat support. In another embodiment, the first arm extends outwardly from the post in a direction opposite to the direction in which the second arm extends from the post.

In another embodiment, each of the first and second arms includes a first arm portion connected to the seat support and a second arm portion connected to the second end of the post. The first arm portion is slidably received within the second arm portion and securable in at least a first position and a second position therein, so that a length of each of the first arm and the second arm is adjustable.

In another embodiment, a seat is supported by and extends downwardly from the seat support, the seat being disposed between the arms. In one embodiment, the seat is coupled to the seat support and extends into the opening. In another embodiment, the seat includes first and second apertures for accommodating a child's legs, and at least a first flap extending downwardly from an underside thereof and intermediate the first and second apertures.

In another embodiment, the seat includes a first flap and a second flap extending downwardly from the underside and intermediate the first and second apertures. Each of the flaps includes a first end and a second end opposite the first end, the first end of the first flap coupled to the first end of the second flap, and the second end of the first flap coupled to the second end of the second flap. In one embodiment, the first ends of the first and second flaps are coupled to the first arm, and the second ends of the first and second flaps are coupled to the second arm.

The present invention also relates to an infant support structure including a base, a connector and a support portion. The connector includes an upper portion and a lower portion, the upper portion having a first mounting portion and a second mounting portion, the lower portion being movably coupled to the base. The support portion is coupled to the connector, and includes a frame member and a support member coupled to the frame member. The frame member and the support member collectively define an infant receiving area. The frame member is coupled to the first mounting portion and the second mounting portion. The support member includes a first opening and a second opening, each of the first opening and the second opening being configured to receive a leg of an infant disposed in the infant receiving area. The first opening and the second opening are located on opposite sides of the connector.

In one embodiment, the frame member defines an opening configured to receive an infant. In another embodiment, the frame member has a substantially circular configuration and the connector has a Y-shaped configuration. In another embodiment, the support member is a fabric member, and the fabric member is disposed beneath the opening of the frame member.

In another embodiment, the lower portion of the connector is aligned with the opening in the frame member. In another embodiment, the base includes an extension, and the lower portion of the connector is slidably mounted to the extension. In another embodiment, the lower portion of the connector is rotatably and slidably coupled to the base.

The present invention also relates to an infant support structure including a seat support having an opening for receiving a child, a base configured to engage a supporting surface, a post connected to and extending upwardly from the base, and first and second arms. Each of the arms extends outwardly from a distal end of the post and is connected to the seat support, thereby connecting the seat support to the base. The infant support structure also includes a guard member having a first end and an opposite second end. The first end of the guard member is coupled to the first arm, and the second end of the guard member is coupled to the second arm.

In one embodiment, the guard member includes an outer shell formed of a fabric material. In another embodiment, the guard member includes a first flap and second flap, each of the first and second flaps having first and second opposite ends. The first end of the first flap is coupled to the first end of the second flap, and the second end of the first flap is coupled to the second end of the second flap.

BRIEF DESCRIPTION OF THE DRAWINGS

Like reference numerals have been used to identify like elements throughout this disclosure.

DETAILED DESCRIPTION OF THE INVENTION

The term "infant support structure" and "support structure" may be used interchangeably herein to refer to a structure that can be configured to hold and support a child or infant. The terms "infant" and "child" may be used interchangeably herein. In addition, terms such as "left," "right," "top," "bottom," "front," "rear," "side," "height," "length," "width," "upper," "lower," "interior," "exterior," "inner," "outer" and the like, as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

Figure 1:
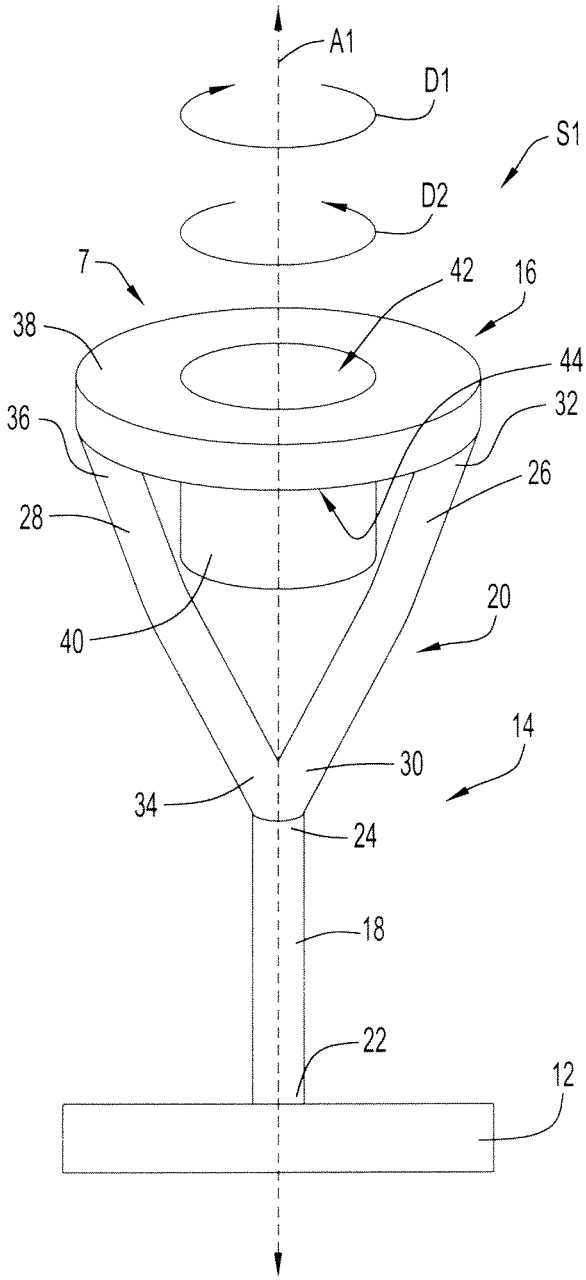
FIG. 1 illustrates a schematic diagram of an infant support structure according to an embodiment of the present invention.

Referring to FIG. 1, a schematic diagram of an infant support structure S1 according to an embodiment of the present invention is illustrated. Infant support structure S1 includes a base 12, a connector 14, and a support portion 16. The connector 14 includes a lower portion 18 coupled to the base 12, and an upper portion 20 coupled to the support portion 16, thereby coupling the base 12 to the support portion 16.

The lower portion 18 of the connector 14 includes a first end 22 connected to the base 12 and a distal second end 24. The first end 22 may be rotatably connected to the base 12 so that the support portion 16 is rotatable about a vertical axis A1 in a first direction shown by arrow D1, and/or a second direction shown by arrow D2 opposite the first direction D1. Alternatively, the second end 24 of the lower portion 18 may be rotatably connected to the upper portion 20, so that again the support portion 16 is rotatable about axis A1 in the first and/or second directions D1, D2.

The upper portion 20 of the connector 14 may include a first mounting portion 26 and a second mounting portion 28. The first mounting portion 26 includes a first end 30 coupled to the distal second end 24 of the lower portion 18, and a second end 32 opposite the first end 30 and coupled to the support portion 16. Similarly, the second mounting portion 28 includes a first end 34 coupled to the to the distal second end 24 of the lower portion 18, and a second end 36 opposite the first end 34 and coupled to the support portion 16. The first and second mounting portions 26, 28 and the lower portion 18 of the connector 14 may together have a generally Y-shaped configuration (as illustrated).

The support portion 16 may include a frame member 38 and a seat member 40 coupled to the frame member 38. The frame member 38 may have a generally circular configuration, and defines an opening 42. The frame member 38 is coupled to the first mounting portion 26 and the second mounting portion 28, thereby coupling the support portion 16 to the base 12. The seat member 40 is coupled to the frame member 38, and extends downwardly from the opening 42 and away from an underside 44 of the frame member 38. The frame member 38 and the seat member 40 collectively define an infant receiving area X, wherein an infant is received through the opening 42 of the frame member 38 and supported by the seat member 40.

The lower portion 18 of the connector 14 is preferably aligned with the opening 42 of the frame member 38. In one embodiment, the longitudinal axis of the lower portion 18 is axially aligned with a center of the opening 42 and along vertical axis A1.

Figure 2:
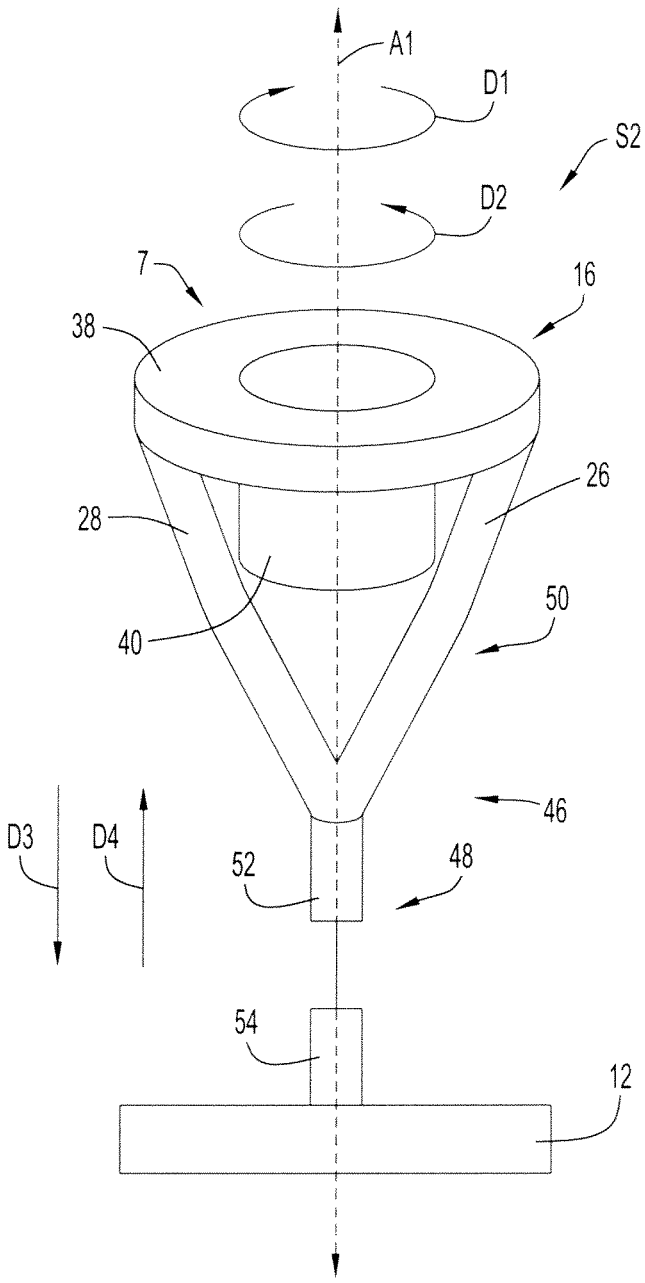
FIG. 2 illustrates a schematic diagram of an infant support structure according to another embodiment.

Referring to FIG. 2, a schematic diagram of an infant support structure S2 according to another embodiment is illustrated. Infant support structure S2 includes the base 12 and the support portion 16, as described above. In addition, infant support structure S2 includes a connector 46 having a lower portion 48 coupled to the base 12 and an upper portion 50 coupled to the support portion 16, so that the support portion 16 is coupled to the base 12.

The lower portion 48 of the connector 46 includes a first section 52 and a second section 54 movably connected to the first section 52. The first section 52 may be linearly movable relative to the second section 54 and along axis A1 in a third direction D3 and a fourth direction D4 opposite the third direction D3, so that the support portion 16 is movable toward the base 12 in the third direction D3 and away from the base 12 in the fourth direction D4. Alternatively or in addition, the first section 52 may be rotatably movable relative to the second section 54 about axis A1 in the first direction D1 and/or the second direction D2. Alternatively, the second section 54 may be rotatably connected to the base 12. Thus, infant support structure S2 permits an infant disposed in the infant receiving area X to bounce up and down in the third and fourth directions D3, D4 and/or to spin in the first and second directions D1, D2.

Figure 3:
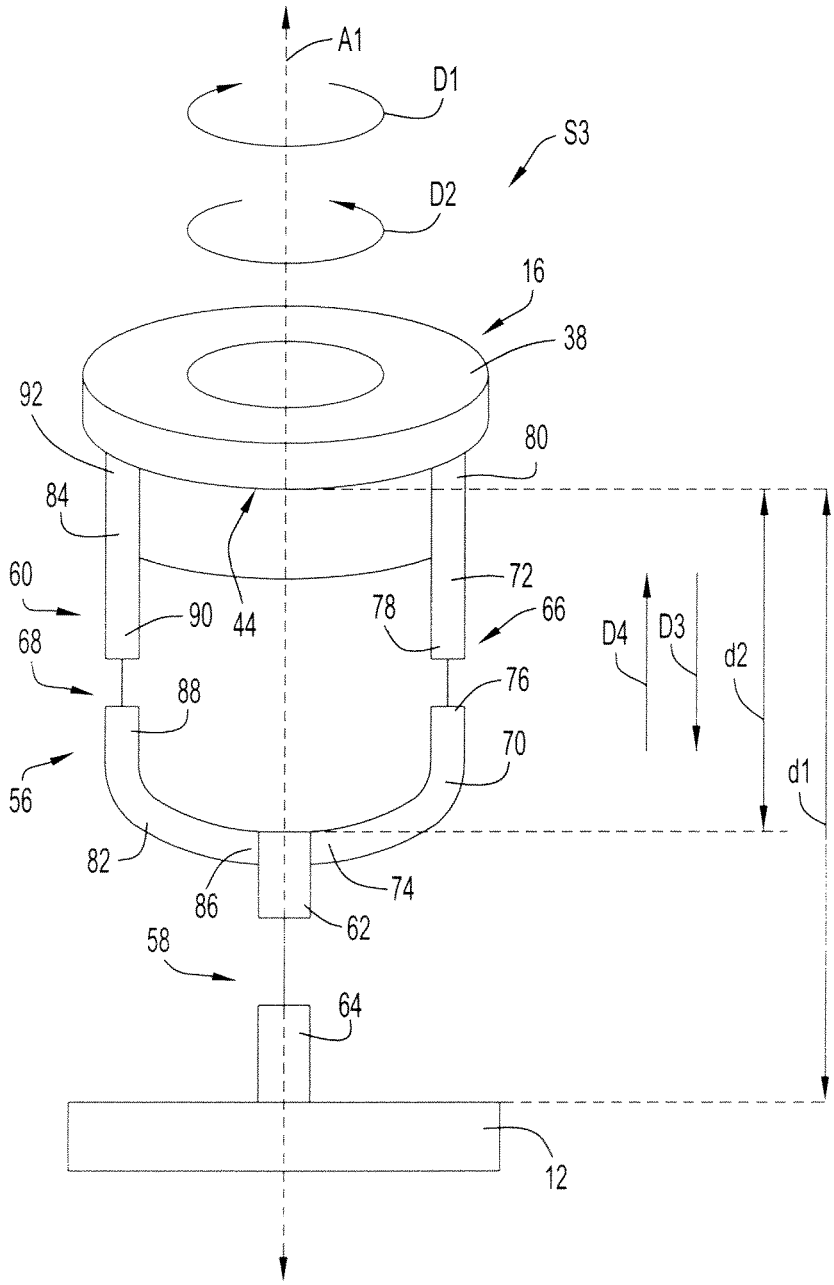
FIG. 3 illustrates a schematic diagram of an infant support structure according to another embodiment.

Referring to FIG. 3, a schematic diagram of an infant support structure S3 according to another embodiment is illustrated. Infant support structure S3 includes the base 12 and the support portion 16, as described above. In addition, infant support structure S2 includes a connector 56 having a lower portion 58 coupled to the base 12 and an upper portion 60 coupled to the support portion 16, so that the support portion 16 is coupled to the base 12.

The lower portion 58 of the connector 56 is similar to lower portion 48, and includes a first section 62 and a second section 64 linearly and/or rotatably movable relative to the first section 62. Thus, the support portion 16 of infant support structure S3 may be linearly movable toward and away from the base 12 in the third and fourth directions D3, D4 and/or rotatable in the first and second directions D1, D2.

The upper portion 60 of the connector 56 includes a first mounting portion 66 and a second mounting portion 68. The first mounting portion 66 includes a first element 70 and a second element 72 linearly movable relative to the first element 70 in the third and fourth directions D3, D4. The first element 70 includes a first end 74 coupled to the first section 62 of the connector 56, and a second distal end 76. The second element 72 includes a first end 78 movably coupled to the second distal end 76 of the first element 70, and a second end 80 coupled to the support portion 16.

Similarly, the second mounting portion 68 includes a first element 82 and a second element 84 linearly movable relative to the first element 82 in the third and fourth directions D3, D4. The first element 82 of the second mounting portion 68 includes a first end 86 coupled to the first section 62 of the connector 56, and a second distal end 88. The second element 84 includes a first end 90 movably coupled to the second distal end 88 of the first element 82, and a second end 92 coupled to the support portion 16.

The second distal ends 76, 88 of the first elements 70, 82, respectively, are linearly movable toward and away from the second elements 72, 84, so that the support portion 16 is movable toward and away from the base 12 in the third and fourth directions D3, D4, respectively. Preferably, the second distal ends 76, 88 of the first elements 70, 82 may be releasably retained at a selected distance from the second elements 72, 84, so that the underside 44 of the support portion 16 may be retained at a selected distance d1 from the base 12. In this way, the height of the support portion 16 may be adjusted. In addition, a distance d2 between the underside 44 of the support portion 16 and the first ends 74, 86 of the first elements 70, 82, respectively, may be selectively adjusted by moving the distal ends 76, 88 of the first elements 70, 82 toward or away from the second elements 72, 84.

Figure 4:
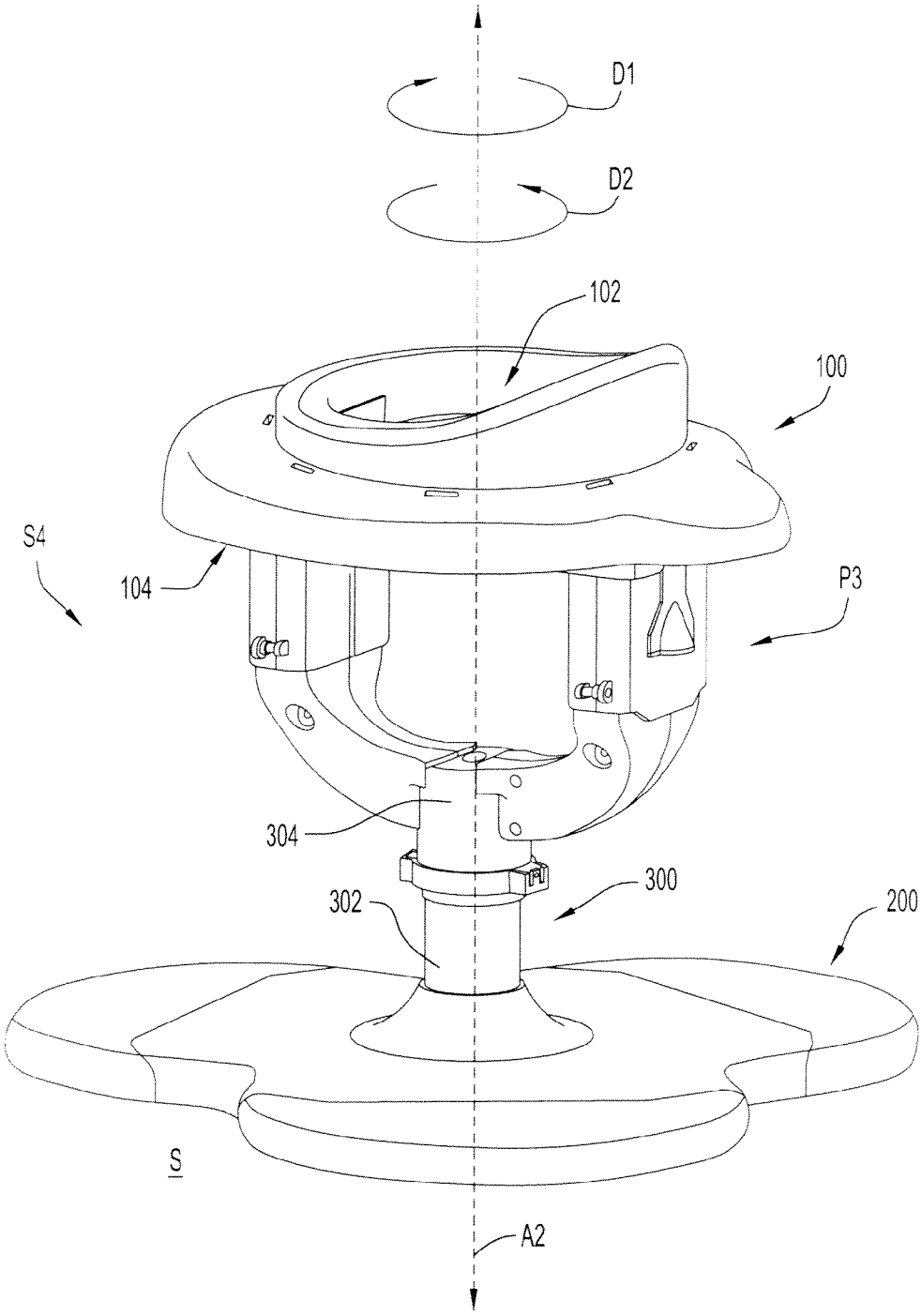
FIG. 4 illustrates a perspective view of a jumper/entertainer seat in a lowered position according to an embodiment of the present invention.
Figure 5:
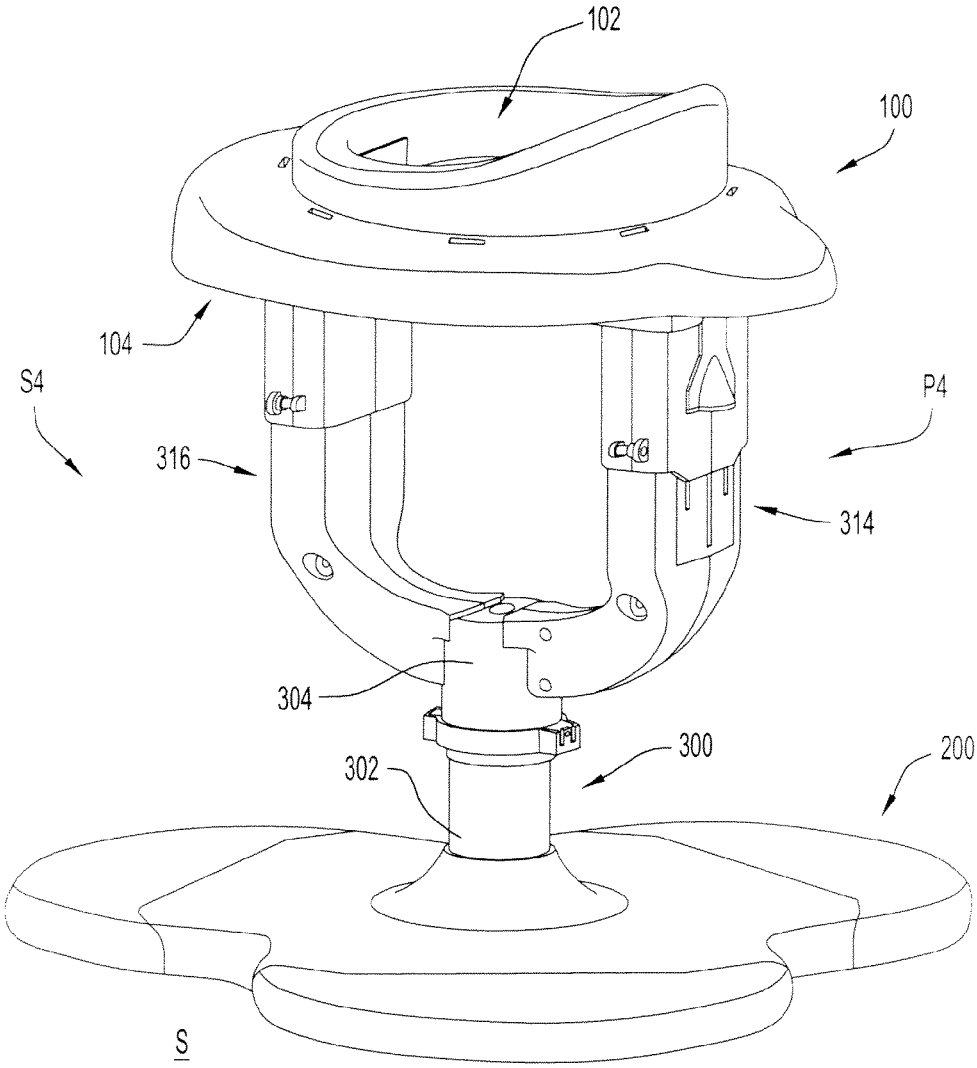
FIG. 5 illustrates a perspective view of the jumper/entertainer seat of FIG. 4 in a raised position.

A jumper/entertainer seat S4 according to another embodiment is illustrated in FIGS. 4 and 5. Jumper/entertainer seat S4 includes a seat support 100 having an opening 102 for receiving a child, a base 200 configured to engage a supporting surface S, and a post 300 having a first end 302 coupled to the base 200 and an opposite second end 304 coupled to the seat support 100. A seat (such as seat 800 described below) is supported by and extends downwardly from an underside 104 of the seat support 100.

The post 300 extends upwardly from the base 200 and is aligned with the opening 102 in the seat support 100. Preferably, a longitudinal axis A2 of the post 300 is aligned with the opening 102, and may be aligned with a center of the opening 102. The first end 302 of the post 300 may be rotatably connected to the base 200, so that the seat support 100 is rotatable relative to the base 200 in the first and/or second directions D1, D2.

Figure 6:
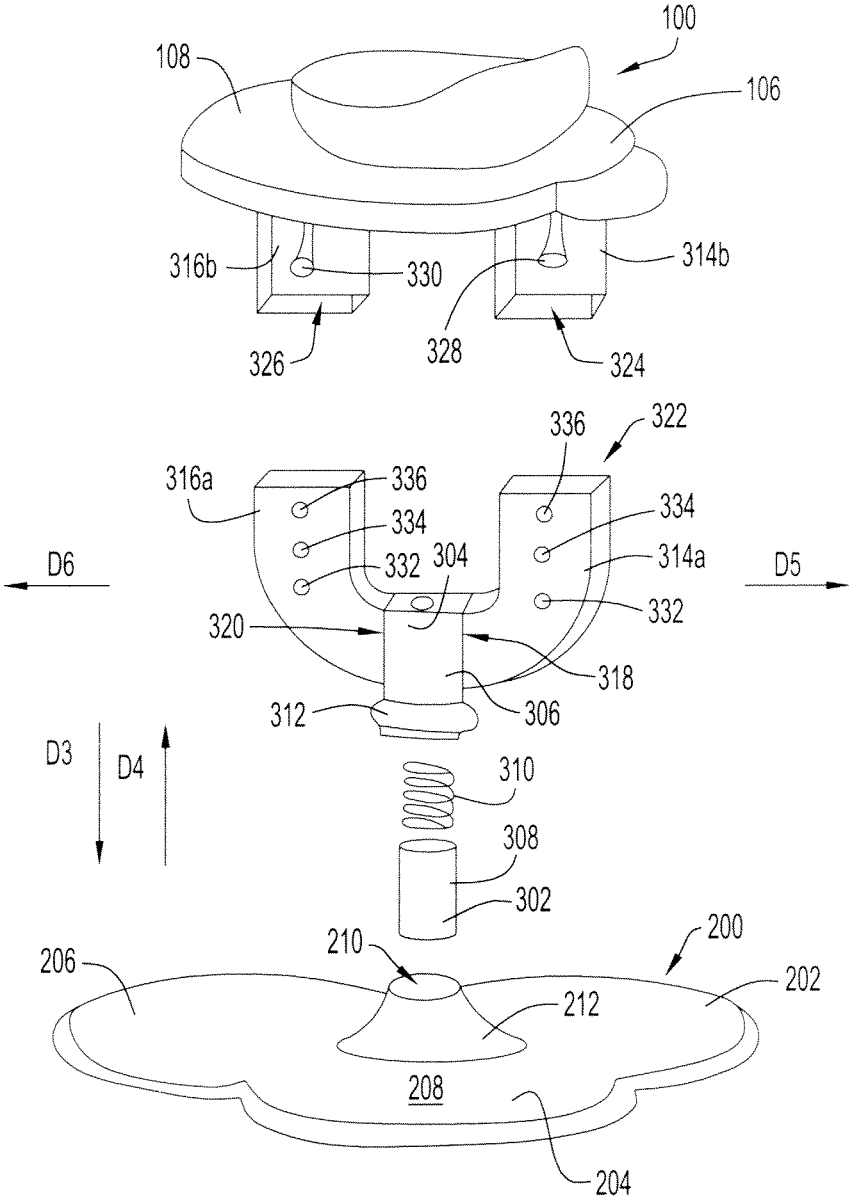
FIG. 6 illustrates an exploded perspective assembly view of the jumper/entertainer seat of FIG. 4.

Alternatively or in addition and referring to FIG. 6, the post 300 may include a first connector portion 306 rotatably connected to a second connector portion 308, so that the seat support 100 is rotatable relative to the base 200 in the first and/or second directions D1, D2. Further, the first connector portion 306 may be linearly movable toward and away from the second connector portion 308 in the third and fourth directions D3, D4. For example, the first and second connectors 306, 308 may be telescopically connected, and movable between an expanded position P1 shown in FIG. 7 and a compressed position P2 shown in FIG. 8. The post 300 has a first length in the expanded position P1 and a second length in the compressed position P2, the first length being greater than the second length.

Preferably, the first and second connector portions 306, 308 are biased toward the expanded position P1 via a resilient member, such as a spring 310, shown in FIG. 6. In the expanded position P1, the seat support 100 is in a rest or unbiased position. The seat (e.g. seat 800 described in detail below) connected to the seat support 100 may be loaded by the weight of the child, thereby compressing the spring 310 so that the first and second connector portions 306, 308 move toward the compressed position P2. When the child moves, such as by bouncing up and down, the forces applied to the spring 310 fluctuate, so that the seat portion 100 moves up and down relative to the base 200 in the third and fourth directions D3, D4.

It may be desirable to maintain the length of the post 300 in a fixed orientation. A collar 312 may be disposed around the first connector portion 306, which tightens into the second connector portion 308 and releasably retains the first and second connector portions 306, 308 in a selected position relative to each other. In this way, the bouncing motion of the first and second connector portions 306, 308 may be selectively arrested, and the length of the post 300 selectively fixed. In turn, the height of the seat support 100 and thus seat relative to the base 200 may be selectively fixed.

Referring again to FIGS. 5 and 6, the second end 304 of the post 300 is coupled to the seat support 100 via first and second arms 314, 316. The first arm 314 extends outwardly from a first side 318 of the post 300 in a fifth direction D5, and the second arm 316 extends outwardly from a second side 320 of the post 300 in a sixth direction D6 opposite the first direction. Thus, the first arm 314 and the second arm 316 may extend outwardly from the longitudinal axis A2 of the post 300 (shown in FIG. 4), and radially spaced about the longitudinal axis A2 by an angle of approximately 180°.

The first and second arms 314, 316 may be separately formed components, or integrally formed as a single component, and together form a connector 322 having a U-shaped configuration. The connector 322 and the post 300 may collectively have a Y-shaped configuration. The first arm 314 may include a first arm portion 314*a* and a second arm portion 314*b* movably connected to the first arm portion 314*a*. Similarly, the second arm 316 may include a first arm portion 316*a* and a second arm portion 316*b* movably connected to the first arm portion 316*a*. The second arm portions 314*b*, 316*b* are linearly movable toward and away from the first arm portions 314*a*, 316*a* in the third and fourth directions D3, D4, and releasably maintainable in a selected position. The second arm portions 314*b*, 316*b* may be telescopically connected to the first arm portions 314*a*, 316*a*, so that the second arm portions 314*b*, 316*b* are slidable toward or away from the first arm portions 314*a*, 316*a*. Thus, the overall lengths of the first and second arms 314, 316 may be adjustably selected.

Preferably, the first arm portions 314*a*, 316*a* are releasably securable in at least first and second positions relative to the second arm portions 314*b*, 316*b*. For example, the first arm portions 314*a*, 316*a* may slide into corresponding cavities 324, 326 in the second arm portions 314*b*, 316*b*, respectively, and releasably secured therein in a lowered position P3 as shown in FIG. 4. The second arm portions 314*b*, 316*b* may then be extended outwardly and away from the first arm portions 314*a*, 316*a*, and secured in a raised position P4 as shown in FIG. 5. In this way, the distance between the support portion 100 and the base 200 is adjustably selectable. Further, the distance between the underside 104 of the support portion 100 and the second end 304 of the post 300 is adjustably selectable.

Any retaining mechanism may be employed for releasably securing the first and second arms 314, 316 in the lowered position P1, the raised position P2, and/or positions intermediate the lowered position P1 and the raised position P2. For example, each of the second arm portions 314*b*, 316*b* may include openings 328, 330, respectively, and each of the first arm portions 314*a*, 316*a* may include a plurality of outwardly extending knobs 332, 334, 336. A selected knob 332-336 is received in a corresponding one of the openings 328, 330, thereby releasably retaining the second arm portions 314*b*, 316*b* and the first arm portions 314*a*, 316*a* in a selected position relative to each other.

The first arm portions 314*a*, 316*a* and/or the second arm portions 314*b*, 316*b* are preferably formed from a relatively resilient material, such as a polymer material. In order to release the selected knob 332-336 from each of the openings 328, 330, the second arm portions 314*b*, 316*b* may be deflected outwardly by the user, or the knob 332-336 may be depressed inwardly by the user, a distance sufficient to dislodge the selected knob 332-336 from the corresponding openings 328, 330. Once dislodged, the length of the first and second arms 314, 316 may be re-adjusted by sliding the second arm portions 314*b*, 316*b* in the third direction D3 or the fourth direction D4, until another pair of knobs 332-336 is aligned with the openings 328, 330. The newly selected pair of knobs 332-336 are biased into the openings 328, 330 due to the resilient nature of the material forming the first and/or second arms 314, 316, thereby releasably locking the support portion 100 at a desired height.

It would be readily apparent to one skilled in the art that other mechanisms for releasably retaining the first arm portions 314*a*, 316*a* and the second arm portions 314*b*, 316*b* in a selected relative position may be employed. For example, the first arm portions 314*a*, 316*a* may include spring-loaded protrusions which are biased outwardly and received in corresponding openings in the second arm portions 314*b*, 316*b*. Alternatively, pins may be provided, which extend through corresponding openings in the first arm portions 314*a*, 316*a* and/or the second arm portions 314*b*, 316*b*.

The second arm portion 314*b* of the first arm 314 is connected to a first side 106 of the seat support 100, and the second arm portion 316*b* of the second arm 316 is connected to a second side 108 of the seat support 100. The first arm portion 314*a* of the first arm 314 is connected to the first side 318 of the first connector portion 306 of the post 300, and the first arm portion 316*a* of the second arm 316 is connected to the second side 320 of the first connector portion 306 of the post. In this way, the seat support 100 is coupled to the post 300, and the distance between the underside 104 of the seat support 100 and the post 300 is adjustable via adjustment of the first and second arms 314, 316. In addition, the opening 102 of the seat support 100 is intermediate the first and second arms 314, 316, so that the seat (e.g. seat 800) is disposed intermediate the first and second arms 314, 316.

Referring again to FIG. 6, the base 200 of jumper/entertainer seat S4 may have a generally clover-like configuration, including three lobes 202, 204, 206, with the post 300 extending upwardly from a central portion 208. The central portion 208 may include a well 210 defined in part by a sloped sidewall 212. The first end 302 of the post 300 and/or the second connector portion 308 are received in the well 210, and may be rotatable therein as described above. Alternatively, the second connector portion 308 may be integrally formed with the base 200. Preferably, the base 200 has a footprint slightly larger than the footprint of the seat support 100.

Figure 9:
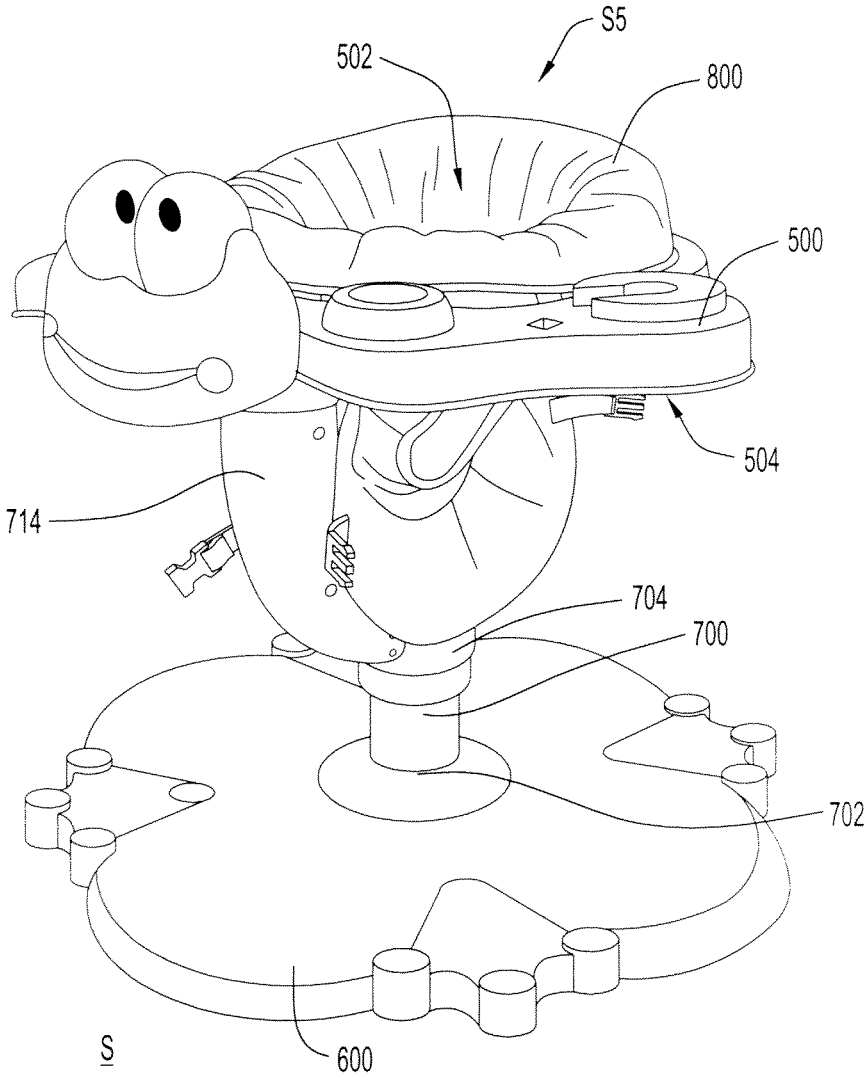
FIG. 9 illustrates a perspective front view of a jumper/entertainer seat according to another embodiment.
Figure 10:
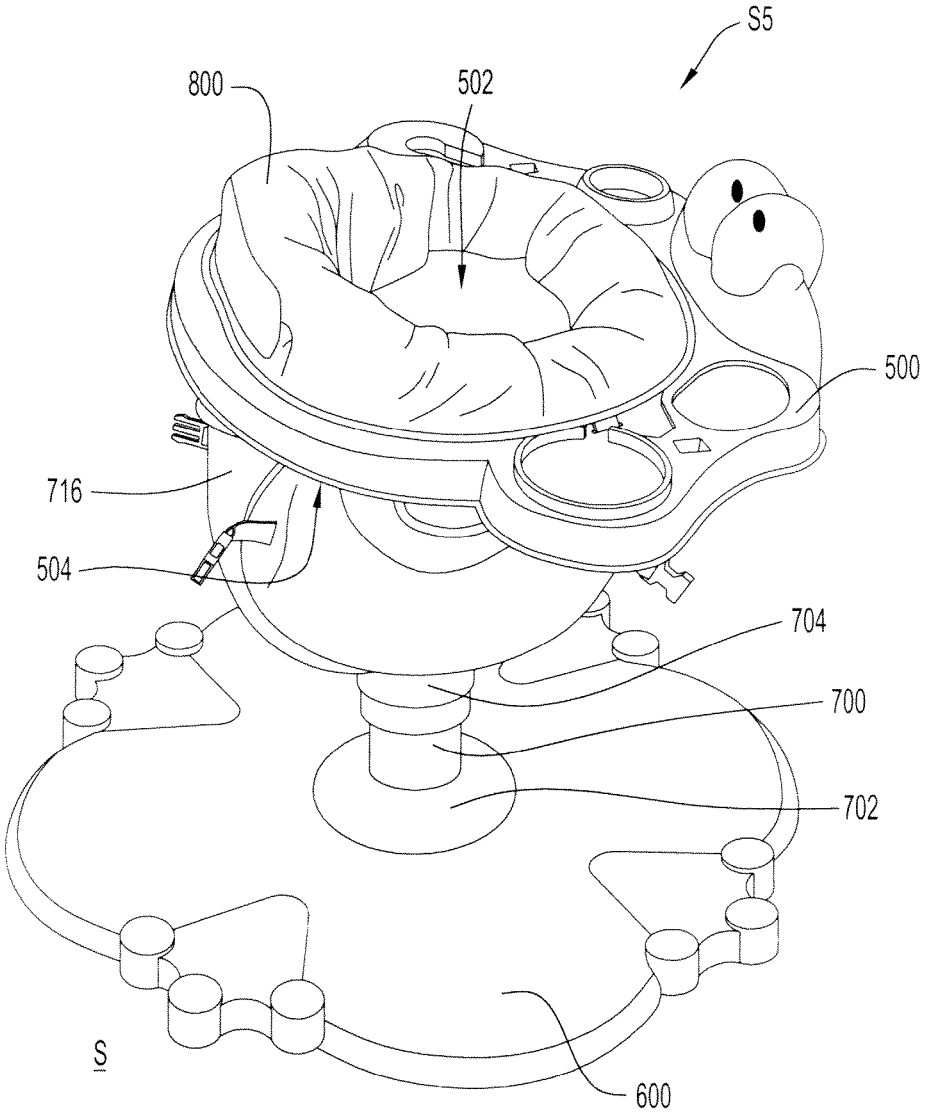
FIG. 10 illustrates a perspective rear view of the jumper/entertainer seat of FIG. 9.

A jumper/entertainer seat S5 according to another embodiment is illustrated in FIGS. 9 and 10. Jumper/entertainer seat S5 includes a seat support 500 having an opening 502 for receiving a child, a base 600 configured to engage a supporting surface S, and a post 700 having a first end 702 coupled to the base 600 and an opposite second end 704 coupled to the seat support 500. A seat 800 is supported by and extends downwardly from an underside 504 of the seat support 500.

Figure 7:
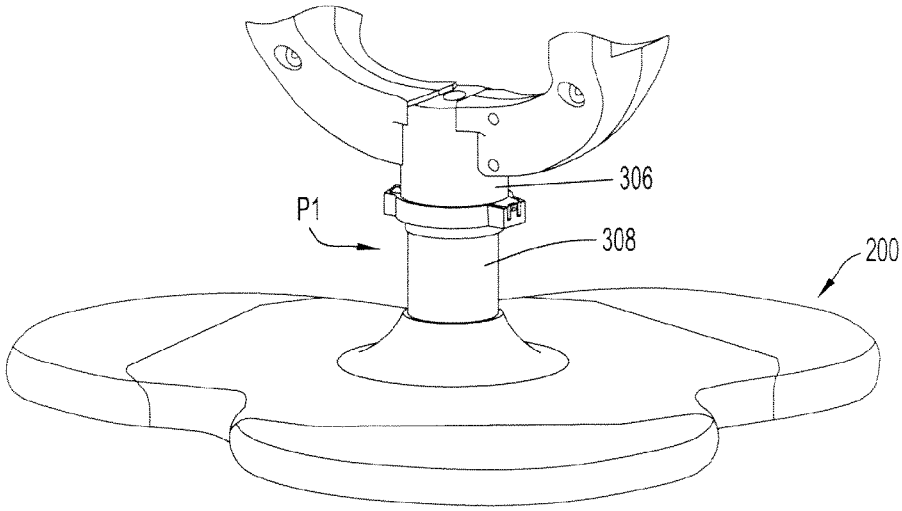
FIG. 7 illustrates a fragmentary perspective view of the jumper/entertainer seat of FIG. 4 in an expanded position.
Figure 8:
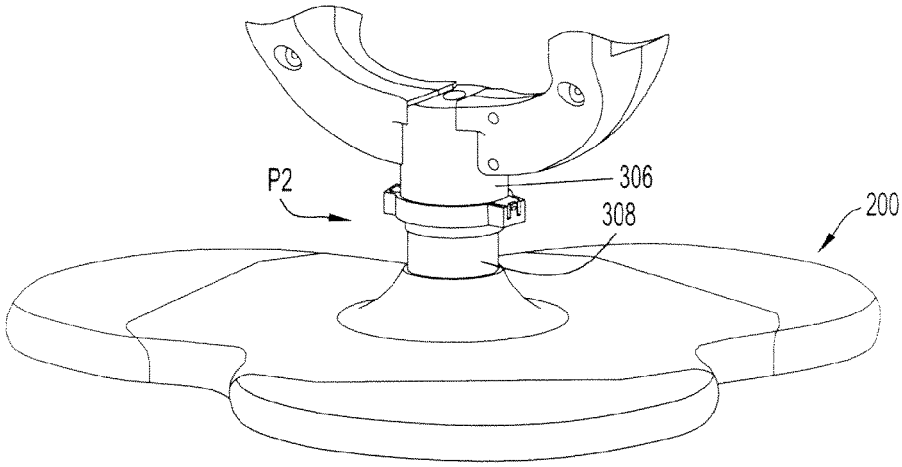
FIG. 8 illustrates a fragmentary perspective view of the jumper/entertainer seat of FIG. 4 in a compressed position.
Figure 11:
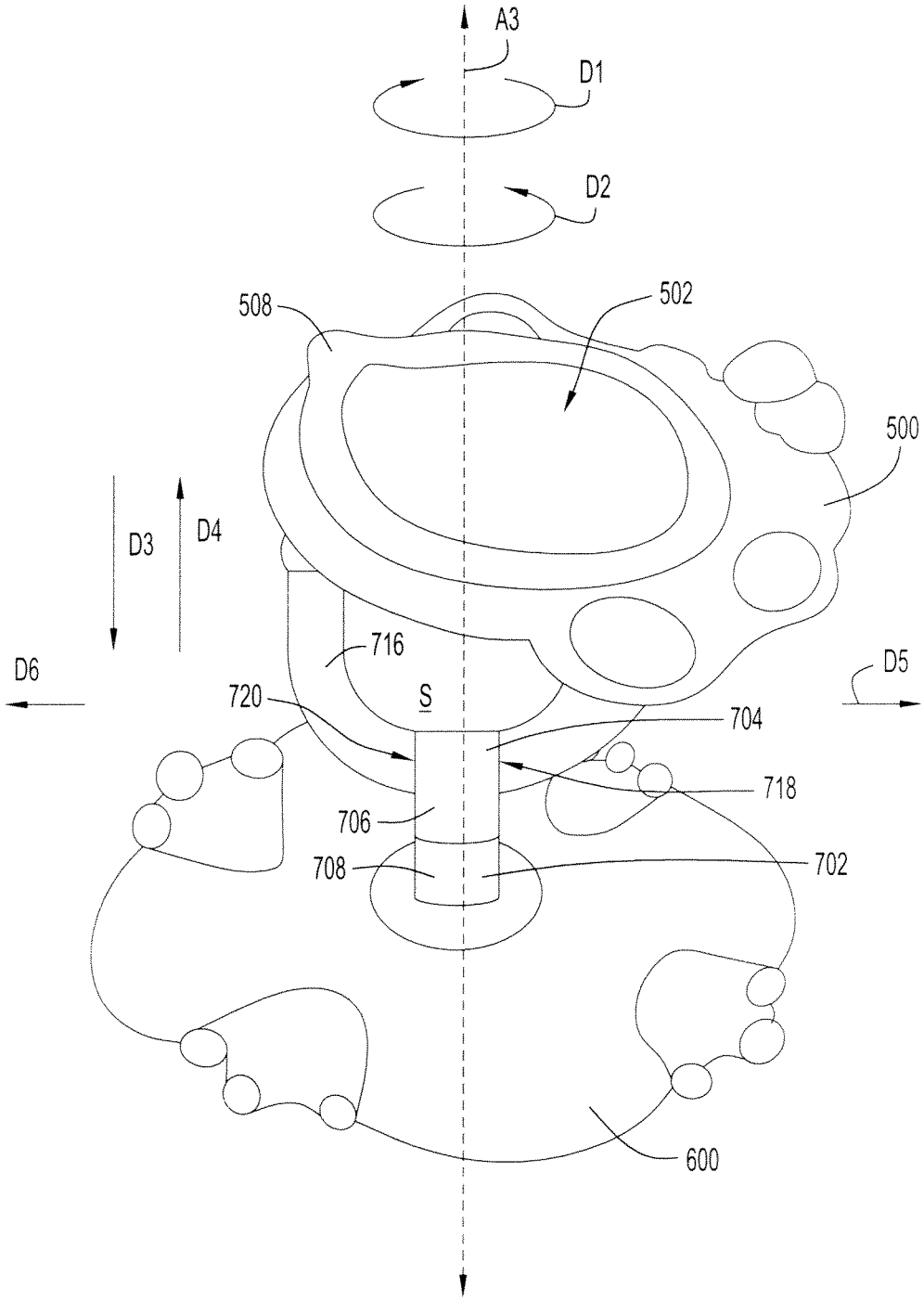
FIG. 11 illustrates a perspective view of components of the jumper/entertainer seat of FIG. 9.
Figure 12:
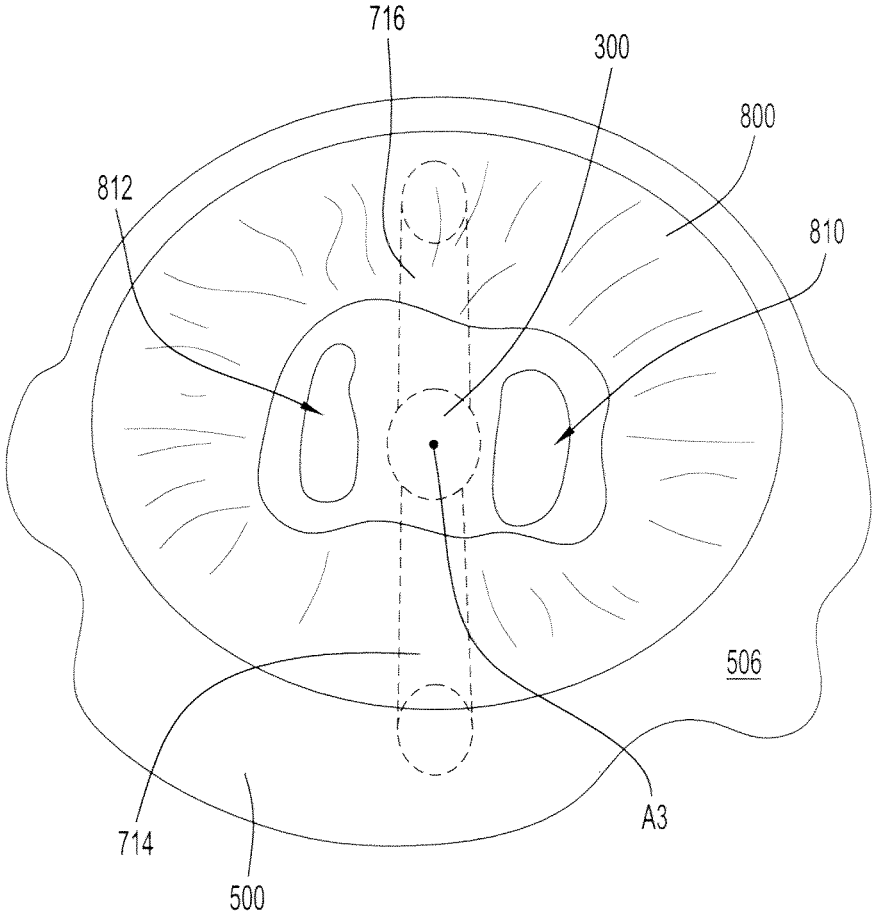
FIG. 12 illustrates a top plan view of the jumper/entertainer seat of FIG. 9 showing the post and the first and second arms in phantom.

As described above and similar to post 300, post 700 extends upwardly from the base 600 and includes a longitudinal axis A3 that is aligned with the opening 502 in the seat support 500, as shown in FIGS. 11 and 12 (the post 300 and the first and second arms 714, 716 shown in phantom in FIG. 12). Further, the first end 702 of the post 700 may be rotatably connected to the base 600, so that the seat support 500 is rotatable relative to the base 600 in the first and/or second directions D1, D2. The post 700 may include a first connector portion 706 rotatably connected to a second connector portion 708, so that the seat support 500 is rotatable relative to the base 600 in the first and/or second directions D1, D2. Further, the first connector portion 706 may be linearly movable toward and away from the second connector portion 708 in a telescopic manner, between an expanded position P1 and a compressed position P2, such as shown in FIGS. 7 and 8 and as described above. The post 700 may include a resilient member, such as spring 310 (shown in FIG. 6), such that forces applied to the spring 310 fluctuate when the child bounces. Thus, the seat support 500 bounces up and down relative base 600 in the third and fourth directions D3, D4.

Also similar to post 300, the second end 704 of the post 700 is coupled to the seat support 500 via first and second arms 714, 716. The first arm 714 extends outwardly from a first side 718 of the post 700 in a fifth direction D5, and the second arm 716 extends outwardly from a second side 720 of the post 700 in a sixth direction D6 opposite the first direction. Thus, the first arm 714 and the second arm 716 may extend outwardly from the longitudinal axis A3 of the post 700, and be radially spaced about the longitudinal axis A3 by an angle of approximately 180°. The opening 502 is intermediate the first and second arms 714, 716, so that the seat 800 is disposed intermediate the first and second arms 714, 716.

Figure 13:
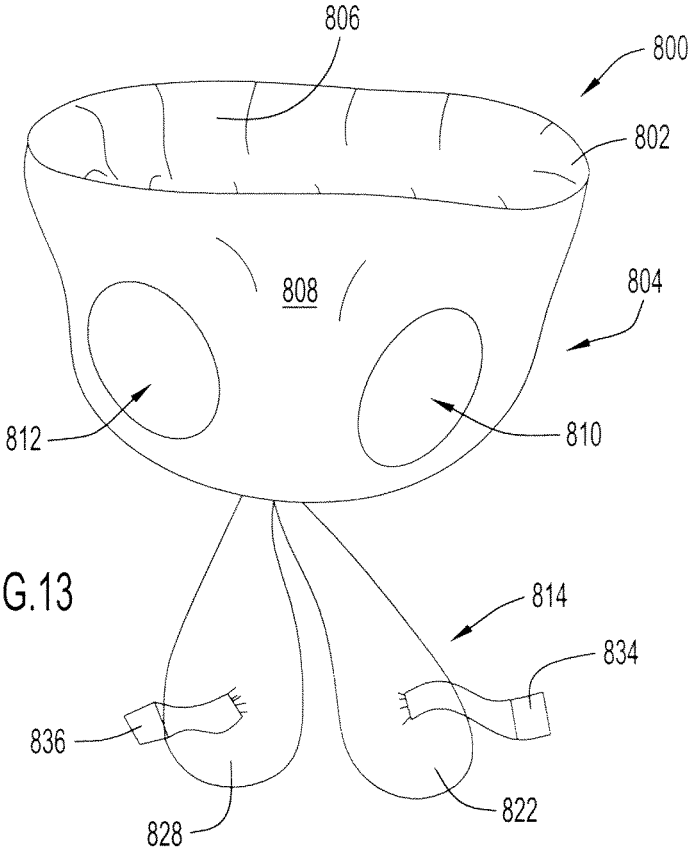
FIG. 13 illustrates a front view of a seat according to the present invention and usable with the disclosed infant support structures.
Figure 14:
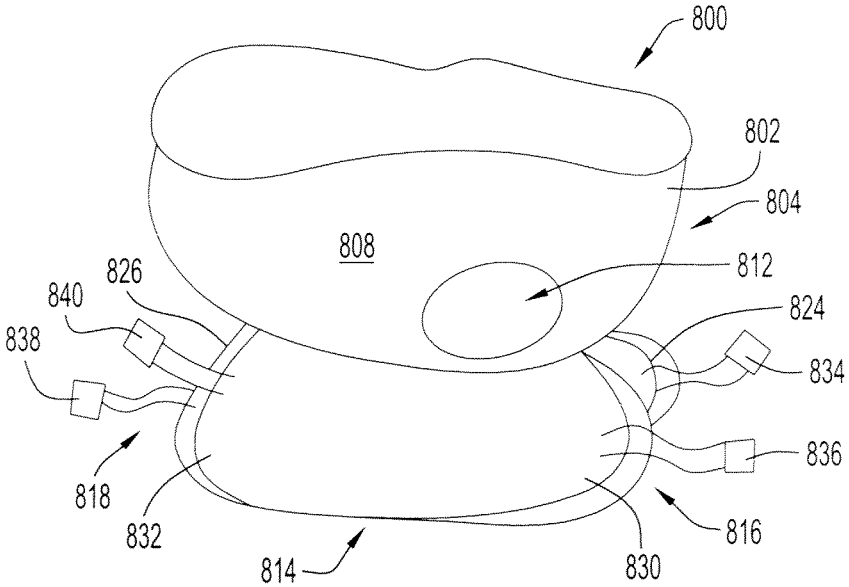
FIG. 14 illustrates a side view of the seat of FIG. 13.

Referring to FIGS. 12, 13 and 14, the seat 800 is preferably formed from a fabric material, and includes an upper edge portion 802 securable to an upper surface 506 of the seat support 500. The upper surface 506 may include a ridge 508 (shown in FIG. 11), which is proximate and/or defines the periphery of the opening 502. The upper edge portion 802 of the seat 800 may be retained on or against the ridge 508 and thus around the opening 502, as shown in FIGS. 9 and 10.

Referring again to FIGS. 13 and 14, the seat 800 includes a central portion 804 having an interiorly disposed surface 806 and an exteriorly disposed surface 808. First and second apertures 810, 812 extend through the central portion 804 and are configured and spaced to accommodate a child's legs. A guard member 814 extends outwardly from the exteriorly disposed surface 808 and downwardly relative to the underside 504 (shown in FIG. 10) of the seat support 500. The guard member 814 is intermediate the first and second apertures 810, 812 and includes a first end 816 that is coupleable to the first arm 714 and a second end 818 that is coupleable to the second arm 716, as shown in FIGS. 9 and 10. The guard member 814 therefore spans between first and second arms 714, 716, and together with the portion of the seat 800 extending downwardly from the underside 504 of the seat portion 500, substantially covers or blocks access to the space S (shown in FIG. 11) bounded by the first and second arms 714, 716, the post 700, and the seat support 500.

When an infant is received in the seat 800, his or her legs extend outwardly from the apertures 810, 812 and straddle the post 700 and the first and second arms 714, 716. The guard member 814 ensures that the child remains in a straddled position with his or her legs extending from opposing sides of the post 700, and with the corresponding arms 714, 716 intermediate the child's legs. The guard member 814 blocks the child from stepping on the first and/or second arms 714, 716 and pushing himself or herself out of the seat 800.

Figure 15:
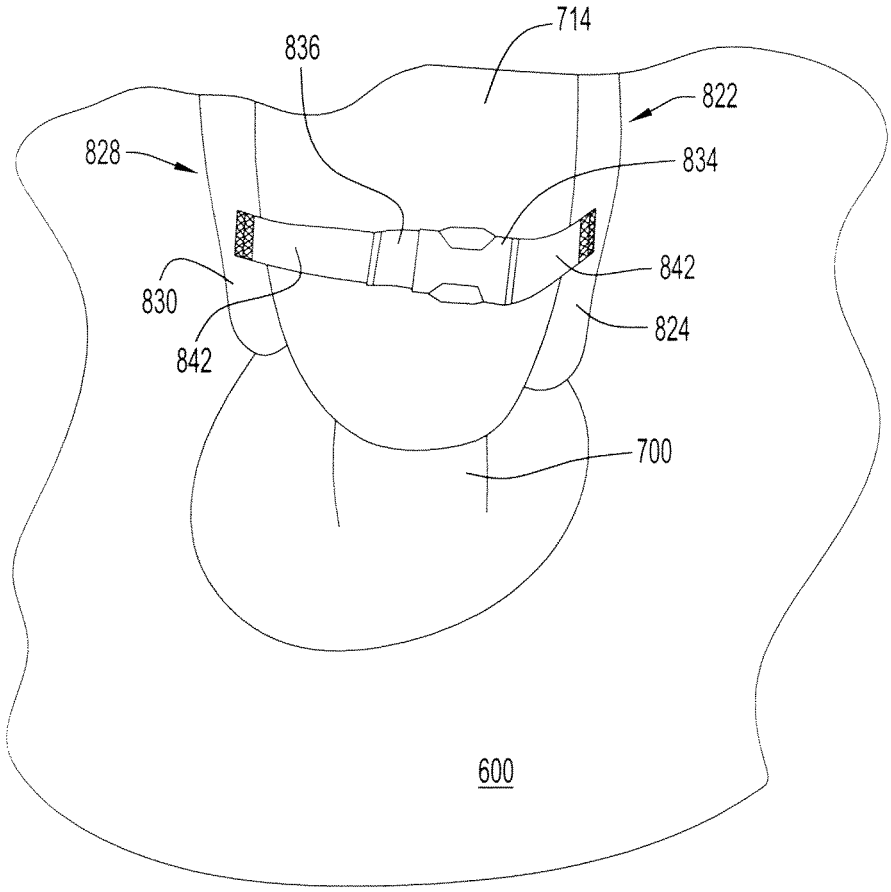
FIG. 15 illustrates fragmentary front view of the jumper/entertainer seat of FIG. 9 showing a guard member releasably coupled to the first arm.

Referring again to FIGS. 13 and 14, the guard member 814 may include a first flap 822 having a first end 824 and an opposite second end 826, and a second flap 828 having a first end 830 and an opposite second end 832. A first fastener 834 extends outwardly from the first end 824 of the first flap 822, and a second fastener 836 extends outwardly from the first end 830 of the second flap 828. A third fastener 838 extends outwardly from the second end 826 of the first flap 822, and a fourth fastener 840 extends outwardly from the second end 832 of the second flap 828. As shown in FIG. 15, the first and second fasteners 834, 836 extend around the first arm 714 and are releasably connectable, so that the first end 824 of the first flap 822 is coupled to the first end 830 of the second flap 828. Similarly, the third and fourth fasteners 838, 840 extend around the second arm 716 and are releasably connectable in a similar manner, so that the second end 826 of the first flap 822 is coupled to the second end 832 of the second flap 828.

The first and second fasteners 834, 836 may be side release buckles, and connected to the corresponding first ends 824, 830 of the first and second flaps 822, 828 via webbing 842, such as polypropylene or nylon webbing. It should be understood that various fastener mechanisms may be employed. Accordingly, the third and fourth fasteners 838, 840 may be side release buckles, or some other fastener mechanism, such as snaps, buckles, buttons, magnets, zippers, hook and loop fasteners, tie strings, etc.

Figure 16:
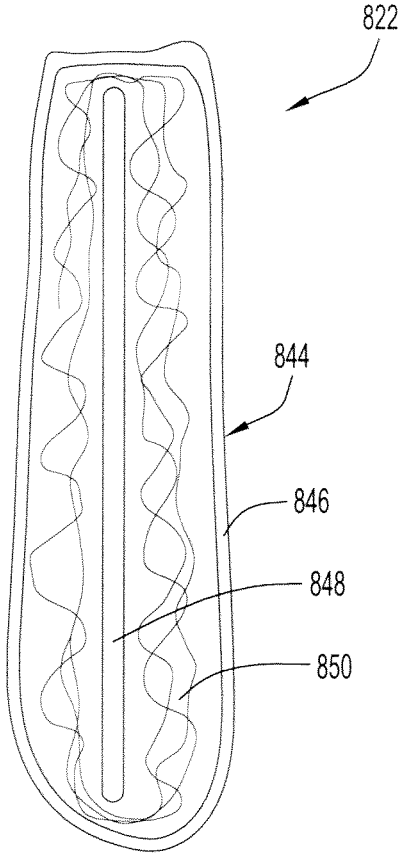
FIG. 16 illustrates a cross sectional view of a first flap of the guard member according to the present invention.

Referring to FIG. 16, the first flap 822 is preferably formed from a flexible material and/or includes an exteriorly disposed surface 844 formed from a material that is non-irritating to a child if in direct contact with the child's skin. For example, the first flap 822 may include an outer shell 846 formed from a fabric material. An internal stiffener member 848, such as a sheet of polymer material, is preferably provided to ensure that the first flap 822 maintains its desired shape. Padding material 850, such as a foam material, may be disposed within the outer shell 846 and surrounding the internal stiffener member 848 to provide additional comfort for a child. The second flap 828 may be identically configured.

Although the guard member 814 is illustrated as including first and second flaps 822, 828, it should be understood that the guard member may alternatively include a single flap and/or three or more flaps. In addition, the guard member 814 need not be directly connected to the seat 800. For example, a guard member could be configured as a rigid plate connected to and extending outwardly from one or more of the first arm 714, the second arm 716 and/or the post 700. Regardless of the specific configuration of the guard member, it preferably covers and blocks access to the space S between the first and second arms 714, 716.

Figure 17:
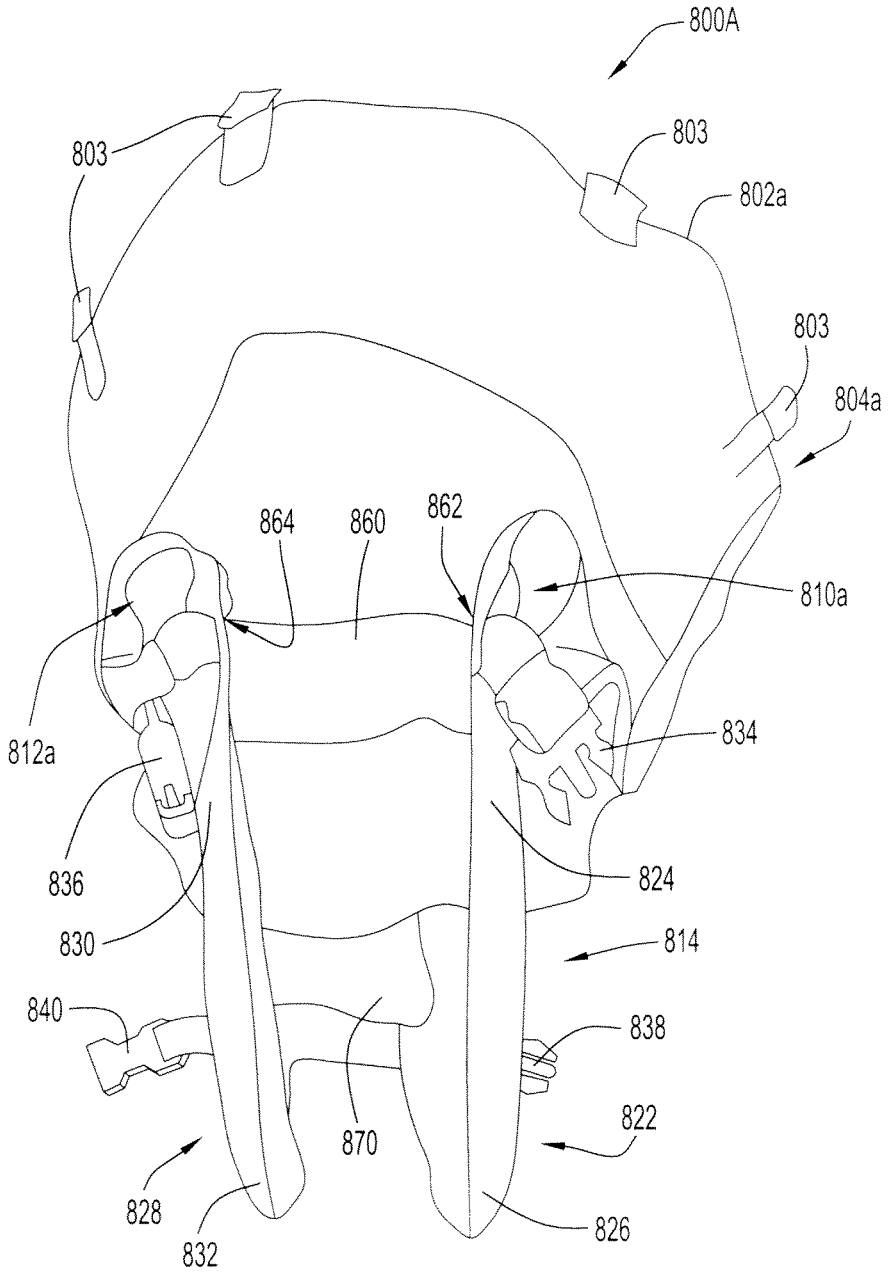
FIG. 17 illustrates a perspective view of a seat according to another embodiment and usable with the disclosed infant support structures.

Further, the seat 800 and/or guard member 814 may include additional fasteners and/or attachment portions for securing the seat 800 to the infant support structure. An alternative configuration of a seat 800A securable to the seat support 500 is illustrated in FIG. 17. Seat 800A is similar to seat 800, and includes an upper edge portion 802*a* securable to the upper surface 506 of the seat support 500, and apertures 810*a*, 812*a* extending through a central portion 804*a* that are configured and spaced to accommodate a child's legs. The upper edge portion 802*a* may include one or more attachment straps 803 releasably insertable in correspondingly configured openings in the upper surface 506 of the seat support 500.

Seat 800A includes guard member 814 having first and second flaps 822, 828. Accordingly, the first fastener 834 extends outwardly from the first end 824 of the first flap 822, and the second fastener 836 extends outwardly from the first end 830 of the second flap 828. In addition, seat 800A includes a locating strap 860 extending between an inner surface 862 of the first flap 822 and an inner surface 864 of the second flap 828 proximate the first ends 824, 830 thereof. The locating strap 860 is positioned between and connecting the first and second flaps 822, 828 so that the first arm 714 (shown in FIG. 15) is releasably maintained between the locating strap 860 and the first and second fasteners 834, 836 when releasably connected together.

Similarly, another locating strap 870 extends between the inner surface 862 of the first flap 822 and the inner surface 864 of the second flap 828 proximate the second ends 826, 832 thereof. The locating strap 870 is positioned between and connecting the first and second flaps 822, 828 so that the second arm 716 is releasably maintained between the locating strap 870 and the third and fourth fasteners 838, 840 when releasably connected together.

In one embodiment, locating straps 860, 870 are formed of a flexible material, such as polypropylene webbing. Locating straps 860, 870 minimize the possibility that the guard member 814 will undesirably move out of position relative to the infant support structure. Locating strap 860 engages a corresponding surface of the first arm 714 and locating strap 870 engages a corresponding surface of the second arm 716, so that the first and second flaps 822, 828 of the guard member 814 are biased toward a centered position relative to the space S (shown in FIG. 11) bounded by the first and second arms 714, 716. Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A jumper/entertainer seat for a child comprising:

a seat support having an opening for receiving a child, the opening having a central axis;

a base configured to engage a supporting surface;

a post having a first end connected to the base and an opposite second end, the post extending upwardly from the base and having a longitudinal axis that is coaxially aligned with the central axis of the opening;

a first arm and a second arm, each of the first arm and the second arm extending outwardly from the second end of the post and being connected to the seat support, thereby connecting the seat support to the base; and a seat coupled to the seat support and extending into the opening, the seat including first and second apertures for accommodating the child's legs, the first and second apertures allowing the child's legs to extend below the seat.

2. The jumper/entertainer seat of claim 1, wherein the first arm is connected to a front portion of the seat support and the second arm is connected to a rear portion of the seat support.

3. The jumper/entertainer seat of claim 1, wherein the first arm extends outwardly from the post in a direction opposite to the direction in which the second arm extends from the post.

4. The jumper/entertainer seat of claim 1, wherein the first end of the post is rotatably connected to the base so that the seat support is rotatable relative to the base.

5. The jumper/entertainer seat of claim 1, wherein each of the first arm and the second arm includes a first arm portion connected to the seat support and a second arm portion connected to the second end of the post, the first arm portion being slidably received within the second arm portion and securable in at least a first position and a second position therein so that a length of each of the first arm and the second arm is adjustable.

6. The jumper/entertainer seat of claim 1, further comprising:

the seat extending downwardly from the seat support, the seat disposed between the arms.

7. The jumper/entertainer seat of claim 1, wherein the post includes a first connector portion and a second connector portion, the first connector portion being rotatably connected to the second connector portion so that the seat support is rotatable relative to the base.

8. The jumper/entertainer seat of claim 7, wherein the first connector portion is slidable toward and away from the second connector portion to allow movement of the seat support toward and away from the base.

9. The jumper/entertainer seat of claim 1, wherein the seat includes at least a first flap extending downwardly from an underside thereof and intermediate the first and second apertures.

10. The jumper/entertainer seat of claim 9, wherein the seat includes a second flap, the first flap and the second flap extending downwardly from the underside and intermediate the first and second apertures, each of the flaps including a first end and a second end opposite the first end, the first end of the first flap coupled to the first end of the second flap, and the second end of the first flap coupled to the second end of the second flap.

11. The jumper/entertainer seat of claim 10, wherein the first ends of the first and second flaps are coupled to the first arm, and the second ends of the first and second flaps are coupled to the second arm.

12. A jumper/entertainer seat for a child comprising:

a support portion having an opening for receiving a child and a seat having first and second apertures for accommodating the child's legs;

a base being configured to engage a supporting surface;

a post having a first end connected to and extending upwardly from the base and an opposite second end, the post having a longitudinal axis that passes through the opening; and a U-shaped connector connected to and extending upwardly from the second end of the post, the U-shaped connector having a first arm and a second arm, each of which is connected to the support portion, wherein the jumper/entertainer seat provides for movement of the child with respect to the supporting surface in only at least one of up and down vertical movement and rotary movement about the longitudinal axis.

13. The jumper/entertainer seat of claim 12, wherein the post is rotatably supported on the base.

14. The jumper/entertainer seat of claim 12, wherein the seat is formed from a fabric material and includes at least a first flap extending downwardly from an underside thereof and intermediate the first and second apertures, the flap having a first end coupled to the first arm and an opposite second end coupled to the second arm.

15. The jumper/entertainer seat of claim 12, wherein the opening has a central axis and the longitudinal axis of the post is coaxially aligned with the central axis of the opening.

16. The jumper/entertainer seat of claim 12, wherein the U-shaped connector and the post collectively form a Y-shape.

17. The jumper/entertainer seat of claim 12, wherein each of the first arm and the second arm are adjustably connected to the support portion in at least a first position and a second position so that a distance between the support portion and the base is adjustable.

18. An infant support structure comprising:

a base;

a connector including an upper portion and a lower portion, the upper portion having a first mounting portion and a second mounting portion, the lower portion being movably coupled to the base and having a longitudinal axis; and a support portion coupled to the connector, the support portion including a frame member and a support member coupled to the frame member, the frame member and the support member collectively defining an infant receiving opening having a center through which the longitudinal axis of the connector passes, the frame member being coupled to the first mounting portion and the second mounting portion, the support member including a first opening and a second opening, each of the first opening and the second opening being configured to receive a leg of an infant disposed in the infant receiving opening, and the first opening and the second opening being located on opposite sides of the connector and the first and second openings allowing the child's legs to extend out of and below the support member.

19. The infant support structure of claim 18, wherein the frame member has a substantially circular configuration and the connector has a Y-shaped configuration.

20. The infant support structure of claim 18, wherein the lower portion of the connector is rotatably and slidably coupled to the base.

21. The infant support structure of claim 18, wherein the frame member defines an opening configured to receive an infant, the support member is a fabric member, and the fabric member is disposed beneath the opening of the frame member.

22. The infant support structure of claim 18, wherein the base includes an extension and the lower portion of the connector is slidably mounted to the extension.

23. An infant support structure comprising:

a seat support having an opening for receiving a child, the opening including a central axis;

a base configured to engage a supporting surface;

a post having a first end connected to the base and an opposite second end, the post extending upwardly from the base and having a longitudinal axis that is coaxially aligned with the central axis of the opening;

a first arm and a second arm, each of the first arm and the second arm extending outwardly from the second end of the post and being connected to the seat support, thereby connecting the seat support to the base; and a guard member having a first end, an opposite second end, a first flap, and second flap, each of the first and second flaps having first and second opposite ends, the first end of the guard member coupled to the first arm and the second end of the guard member coupled to the second arm, the first end of the first flap coupled to the first end of the second flap, and the second end of the first flap coupled to the second end of the second flap.

24. The infant support structure of claim 23, wherein the guard member comprises a flexible outer shell encasing an internal stiffener member.

* * * * *